US010865075B2

(12) United States Patent
Claeys

(10) Patent No.: US 10,865,075 B2
(45) Date of Patent: Dec. 15, 2020

(54) DYNAMIC OPTIMIZATION OF A CRANE LOAD CURVE

(71) Applicant: Manitowoc Crane Group France, Dardilly (FR)

(72) Inventor: Xavier Claeys, Lyons (FR)

(73) Assignee: Manitowoc Crane Group France, Dardilly (FR)

( * ) Notice: Subject to any disclaimer, the term of this patent is extended or adjusted under 35 U.S.C. 154(b) by 292 days.

(21) Appl. No.: 16/138,205

(22) Filed: Sep. 21, 2018

(65) Prior Publication Data

US 2019/0084809 A1 Mar. 21, 2019

(30) Foreign Application Priority Data

Sep. 21, 2017 (FR) ..... 17 58745

(51) Int. Cl.

| | |
|---|---|
| ***B66C 13/48*** | (2006.01) |
| ***B66C 13/06*** | (2006.01) |
| ***B66C 13/22*** | (2006.01) |
| ***B66C 23/90*** | (2006.01) |

(52) U.S. Cl.

CPC ..... *B66C 13/48* (2013.01); *B66C 13/063* (2013.01); *B66C 13/22* (2013.01); *B66C 23/90* (2013.01); *B66C 2700/08* (2013.01)

(58) Field of Classification Search

CPC ..... B66C 13/48; B66C 13/063; B66C 13/06; B66C 13/22; B66C 23/90; B66C 2700/08

See application file for complete search history.

(56) References Cited

U.S. PATENT DOCUMENTS

| | | | | |
|---|---|---|---|---|
| 3,921,818 | A * | 11/1975 | Yamagishi | B66C 13/22 212/275 |
| 5,548,198 | A * | 8/1996 | Backstrand | B66C 13/22 212/285 |
| 9,120,650 | B2 * | 9/2015 | Langer | B66C 13/02 |
| 2008/0275610 | A1 * | 11/2008 | Terashima | B66C 13/063 701/50 |
| 2018/0093868 | A1 * | 4/2018 | Claeys | B66C 13/063 |
| 2018/0229976 | A1 * | 8/2018 | Kawai | B66C 13/28 |
| 2020/0224389 | A1 * | 7/2020 | Takahashi | E02F 9/2095 |

FOREIGN PATENT DOCUMENTS

| | | |
|---|---|---|
| DE | 102015100669 A1 | 7/2015 |
| EP | 0849213 A1 | 6/1998 |

* cited by examiner

*Primary Examiner* — Michael E Gallion

(74) *Attorney, Agent, or Firm* — Levenfeld Pearlstein, LLC

(57) ABSTRACT

A method for controlling command of lifting a load suspended from a boom, carried by a mast of a crane, includes determining: depending on the mass of the suspended load, a specified load factor quantifying an acceptable exceedance with respect to a predetermined maximum allowable load for said crane; a maximum permitted lifting acceleration, depending on the mass of the suspended load, on the specified load factor and on the distribution position of the load suspended on the boom with respect to the mast; from lifting speed setpoints, optimized lifting speed setpoints intended to be executed by a motor device for displacing the suspended load according to a lifting movement so that the acceleration related to the lifting movement remains, in absolute value, less than or equal to the maximum permitted acceleration.

12 Claims, 4 Drawing Sheets

DYNAMIC OPTIMIZATION OF A CRANE LOAD CURVE

CROSS-REFERENCE TO RELATED APPLICATION

This application claims priority under 35 U.S.C. § 119(a) to French Patent Application No. 17/58745, filed on Sep. 21, 2017, the disclosure of which is incorporated by reference herein in its entirety.

FIELD

The present invention relates to the field of cranes, and more specifically tower cranes, and particularly to the monitoring of the maximum load displaced.

BACKGROUND

According to a usual configuration, a tower crane comprises a vertical mast, a substantially horizontal boom carried by the mast and orientable in azimuth about the mast according to a movement called orientation movement, i.e., rotation on a vertical axis of the mast, and a carriage which is movably mounted in radial translation along said boom thereby achieving a movement called distribution movement, i.e., movement along a length of the boom. The carriage carries a load, suspended from the carriage by a cable whose length is modifiable by means of a winch which thus commands the vertical movement of said load, called lifting movement, i.e., movement in a height direction.

One characteristic of the crane is the maximum mass of the suspended load that the crane can move, according to an operating point defined by the distance from said load to the vertical axis passing through the mast—called distribution position—and by the mass of the load.

The maximum limit is typically described by means of a load curve, on a graph representing, on a first axis (conventionally as the abscissa), the distribution position and, on a second axis (conventionally as the ordinate), the mass of the load.

Conventionally, a tower crane has a monitoring and control system configured to limit a lifting speed of the load, when the operating point approaches the load curve.

When the operating point reaches the load curve, the monitoring and control system stops the movements of the crane, in order to avoid a condition in which the operating point is beyond the load curve.

The load curve is generally established, with regard to the mechanical arrangement of the crane, on the one hand, from a first limit called "static" limit which assumes that the crane is in a static mechanical state or in a steady state comparable to a quasi-static state (in particular with a substantially constant or zero lifting speed) and, on the other hand, by further providing, with respect to this first static limit, a dynamic margin, which corresponds to a maximum tolerated exceedance with respect to this static limit, called load factor $\psi$.

Said load factor $\psi$ allows taking into account the additional stress which is exerted on the boom, and more generally on the crane, when the suspended load is subjected to transient phenomena, for example at the beginning of a lifting movement, when the inertia of the suspended load is added to the weight of said suspended load.

Standards, such as the European standard EN 13001, require that the load factor $\psi$ remains below 30%.

In practice, the greater the load factor $\psi$, that is to say the greater the imposed safety margin, the lower the maximum limit of the load that the crane can move.

That is why it is desirable, to improve the performance of the crane, to reduce the load factor $\psi$.

It is thus known, for example from the patent document EP-0 849 213, to implement control means, using a first relatively restrictive load curve in view of the potential capacities of the crane, and a second extended load curve. However, the second load curve can be used only for a predetermined reduced range of displacement speed/acceleration, when the conditions for such an exceedance are met. The use of a switch for selecting, according to the circumstances, the appropriate load curve is particularly provided. The operator can thus manually force the control means to operate the crane by using the second extended load curve. This solution therefore relies on the use of two predefined load curves and allows only partially optimizing the compromise between dynamic crane use performance and load capacity, according to the actual instantaneous capacities of the crane.

That is why there is still a need for improved and automated means, for tower crane, for monitoring and controlling movements according to a load curve, offering an optimized compromise between load lifting capacity and dynamic use performance.

SUMMARY

One of the objects of the invention is to allow taking into account, by the improved monitoring and control means, the capacity at a given moment of a crane, in particular a tower crane, of reducing the influence of the dynamic factors and uncertainties at a determined level.

Another object of the invention is to provide means capable of taking into account, for determining the load factor, the capacities and performance of a crane in the application and control of the speed and acceleration setpoints of the lift motor.

Another object of the invention is to provide improved monitoring and control means for a crane which are able to limit the lifting movements of the payload, in speed and acceleration, using dynamic calculation rules dependent on the current mechanical load, on the range, on the lifting speed and optionally on other characteristic variables of said crane.

One of the objects of the invention is to increase the lifting capacity of a crane, while still operating within predefined load parameters.

One of the objects of the invention is to increase the dynamic use performance of a crane.

One of the objects of the invention is to provide improved monitoring and control means for a crane, which require during their use no action from the crane operator aimed at selecting from several load curves the one adapted to the context for controlling the lifting movements of the load.

One of the objects of the invention is to provide improved monitoring and control means for a crane, using a single load curve to continuously adapt the speed and the acceleration requested by the crane operator in order to meet the dynamic stresses that the crane can withstand.

One of the objects of the invention is to provide improved monitoring and control means for a crane adapted to be used in conjunction with the cut-off devices usually deployed in a crane.

More particularly, according to a first aspect, the invention relates to a method for controlling the command of the lifting of a load suspended from a boom, carried by a mast of a crane, for example, a tower crane. The invention can also be applied to other families of cranes, for example, a luffing boom crane, etc., by transposing the calculations carried out according to the model of the invention to the geometry of said cranes.

In one embodiment, the method includes the following steps:

- a first step of determining, depending on the mass of the suspended load, a specified load factor quantifying an acceptable exceedance with respect to a predetermined maximum allowable load for said crane;
- a second step of determining a maximum permitted lifting acceleration, depending on the mass of the suspended load, on the specified load factor and on the distribution position of the load suspended on the boom with respect to the mast; and
- a third step of determining, from lifting speed setpoints, optimized lifting speed setpoints intended to be executed by a motor device for displacing the suspended load according to a lifting movement so that the acceleration related to the lifting movement remains, in absolute value, less than or equal to the maximum permitted acceleration.

The command method according to the invention allows in particular adapting the control of the crane according to the actual dynamics of the load.

The method thus allows controlling the crane by taking into account the effects of the load when the latter is in a static or quasi-static mechanical state, but also in a transient state during which the inertial effects related to the accelerations/decelerations of the load are observed.

Indeed, during transient states, in particular at the beginning of lifting when the winch accelerates the load, a stress greater than the strict mass of the suspended load is exerted on the boom of the crane: the latter consequently undergoes the equivalent of a load heavier than that effectively suspended from the winch, and therefore responds by a pitch deformation greater than the deformation observed in a quasi-static state.

The invention thus allows dynamically optimizing the control of the crane with respect to the predetermined maximum allowable load for said crane, by limiting the lifting acceleration, according to current measurable parameters, such as the mass of the suspended load, and the distribution position of the suspended load.

The optimization furthermore requires no intervention from the operator.

According to embodiments herein, the invention results in an improvement in the compromise lifting capacity/dynamic use performance, compared to the conventional approaches in which only the predetermined maximum allowable load for said crane would have been taken into account, or approaches based on the use of two static curves of maximum allowable load.

The method is also easily parametrizable to suit various needs, in particular on the choice of the predetermined maximum allowable load.

The maximum permitted lifting acceleration can be determined using the following mathematical expression:

$$\frac{gJ_z}{x_c^2 M + J_z}\psi_0^*$$

wherein:

$x_c$, corresponds to the distribution position of the suspended load;

M corresponds to the mass of the suspended load;

$J_z$ corresponds to a model of stiffness and inertia of the first order related to the structure of the crane;

$\psi_0^*$ is the specified load factor.

Thus, the method according to the invention allows in particular optimizing the control of the crane, by dynamically limiting the acceleration, as well as the speed, of the suspended load, by means of a pre-established mathematical formula.

The specified load factor is for example determined by means of a maximum allowable load curve, corresponding to a limit load factor and to a maximum static load.

Thus, a single maximum allowable load curve can be used, dynamically adapted to the current actual conditions by means of a mathematical formula allowing to take into account the current actual conditions, such as the mass of the suspended load or the distribution position of the suspended load.

It is thus possible to avoid any exceedance of the predetermined maximum allowable load for the crane, while approaching closer to said maximum allowable load.

The limit load factor can be determined from a first theoretical threshold dependent on the theoretical capacities of the load handled by the crane and from a second threshold dependent on measurement uncertainties related to the mass of the suspended load and/or to the lifting movement of the suspended load.

The specified load factor can be obtained by multiplying the limit load factor by the ratio between the maximum static load corresponding to the maximum allowable load curve and the mass of the suspended load.

Thus, because of a better control of the dynamic aspects allowed by the invention, it is possible to use a load factor limit approaching the limits enacted by the standards.

Advantageously, the optimized lifting speed setpoints are determined so that their execution by the motor device for displacing the suspended load according to the lifting movement meets the following condition:

- the lifting acceleration of the suspended load, in absolute value, remains less than or equal to the maximum permitted acceleration (L"MAX); in this case, said maximum permitted acceleration L"MAX corresponds to a theoretical acceleration which is calculated so as not to cause an exceedance of the considered dynamic factor;

as well as one or more of the following additional conditions:

- the lifting speed of the suspended load, in absolute value, remains lower than a maximum permitted lifting speed, the maximum permitted lifting speed being determined depending on the capacities of the crane to slow down the movements of the suspended load; and/or,
- the lifting speed of the suspended load, in absolute value, remains lower than a maximum safety lifting speed, determined depending on the capacities of the crane to withstand a sudden lying of the suspended load on the ground and/or an emergency stopping; and/or,
- the lifting acceleration of the suspended load, in absolute value, remains lower than a maximum lifting acceleration achievable by the motor device; and/or,
- the lifting acceleration of the suspended load, in absolute value, remains greater than a minimal comfort lifting acceleration.

It is therefore possible to optimize the use performance experienced by the operator of the crane.

The optimized lifting speed setpoints can be determined so that the absolute value of the lifting speed of the suspended load increases, over a predefined period of time, along a ramp having a slope which corresponds to the maximum permitted lifting acceleration. It is then possible to limit the inertial effects.

According to a second aspect, the invention relates to a computer program including instructions for performing the steps of the method according to the first aspect, when said program is executed by a processor. The motor device may then be operated based on the performance of the steps of the methods described herein. For example, the processor may control operation of the motor device based on the determinations made in the methods described herein.

Each of these programs can use any programming language, and be in the form of source code, object code, or intermediate code between source code and object code, such as in a partially compiled form, or in any other desirable form. Particularly, it is possible to use the C/C++ language, the language™ of the script languages, such as in particular tcl, javascript, python, perl which allow a code generation "on demand" and do not require significant overload for their generation or modification.

According to a third aspect, the invention relates to a computer-readable recording medium on which is recorded a computer program comprising instructions for performing the steps of the method according to the first aspect. The computer program may be executed by the processor as provided in the embodiments described herein.

The information medium may be any entity or any device capable of storing the program. For example, the medium may include a storage means, such as a ROM, for example a CD-ROM or a microelectronic circuit ROM, or a magnetic recording means, for example a diskette or a hard disk. On the other hand, the information medium may be a transmissible medium such as an electrical or optical signal, which may be conveyed by an electrical or optical cable, by radio or by other means. The program according to the invention can be particularly downloaded on an Internet or Intranet network. Alternatively, the information medium may be an integrated circuit in which the program is incorporated, the circuit being adapted to execute or to be used in the execution of the method in question.

According to a fourth aspect, the invention also relates to a crane, in particular a tower crane, adapted to implement the method according to the first aspect. The crane includes a mast supporting a boom on which is mounted a carriage intended to carry a suspended load. The crane further includes means for controlling the command of the lifting of the suspended load, provided:

- with means for determining, depending on the mass of the suspended load, a specified load factor quantifying an acceptable exceedance with respect to a predetermined maximum allowable load for said crane;
- with means for determining a maximum permitted lifting acceleration, depending on the mass of the suspended load, on the specified load factor and on the distribution position of the load suspended on the boom with respect to the mast; and
- with means for determining, from lifting speed setpoints, optimized lifting speed setpoints intended to be executed by a motor device for displacing the suspended load according to a lifting movement so that the acceleration related to the lifting movement remains, in absolute value, less than or equal to the maximum permitted acceleration.

The invention can also be applied to other families of cranes, including but not limited to, a luffing boom crane and the like, by transposing the calculations carried out according to the model of the invention to the geometry of said cranes.

BRIEF DESCRIPTION OF THE DRAWINGS

Other features and advantages of the present invention will become apparent in the following description of embodiments with reference to the accompanying drawings, in which.

DESCRIPTION

Figure 1:
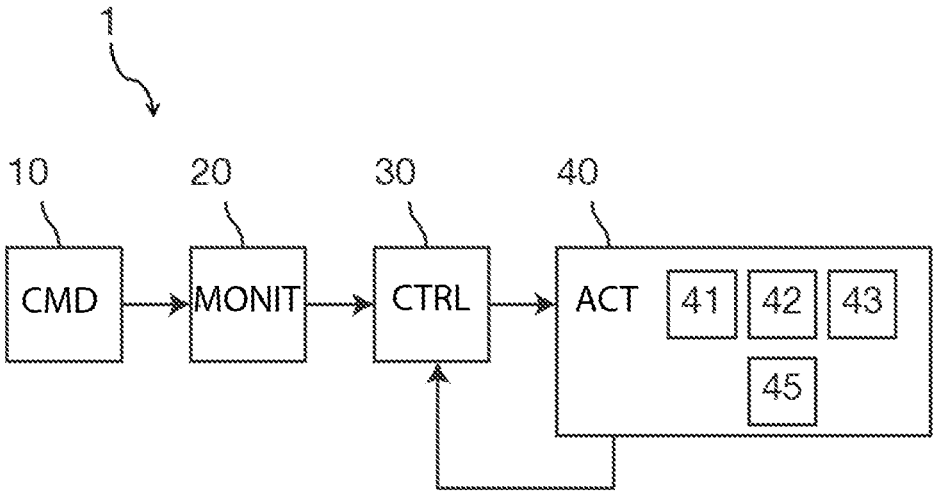
FIG. 1 is an architecture diagram of a lifting control system of a load, according to one embodiment.
Figure 4:
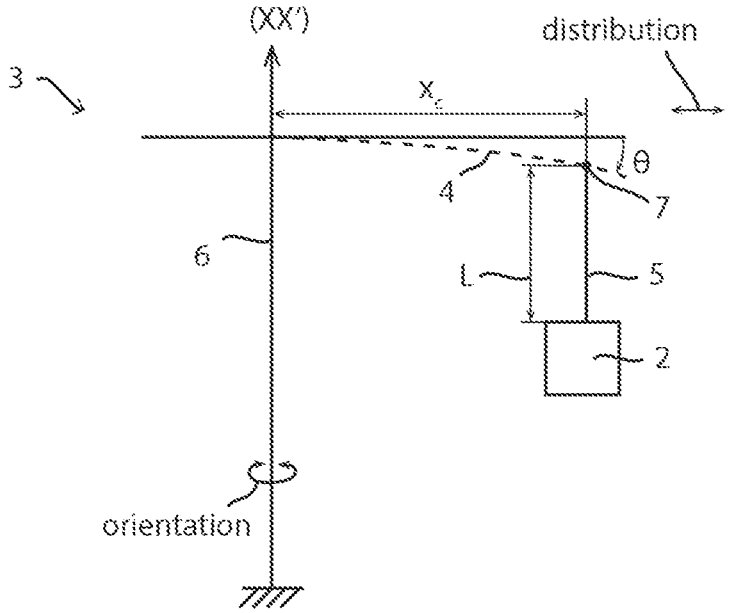
FIG. 4 represents a block diagram used to describe an oscillator-type mechanical model used, according to an embodiment of the method according to the invention, for determining the maximum permitted lifting acceleration.

Reference is made to FIG. 1 which shows a system 1 for controlling the lifting of a suspended load 2 (shown in FIG. 4).

This system 1 is applicable to a crane 3, and in particular a tower crane 3 (shown in FIG. 4).

With reference to FIG. 4, it is conceivable to apply the system 1 to any type of crane 3 comprising a boom 4 which is yaw-orientable about a vertical axis (ZZ'), according to an orientation movement, e.g., slewing movement on the vertical axis, and which is arranged so that the suspended load 2 is suspended from said boom 4 by a cable 5, and thus in such a way that said crane 3 can modify the radial distance of said suspended load 2 with respect to the vertical axis, according to a distribution movement, as well as the length of the cable 5 which connects the boom 4 to the suspended load 2, according to a movement called lifting movement, in order to be able to modify the altitude of the suspended load 2.

The crane 3 can thus form for example a luffing boom crane (tilting boom), a telescopic crane or a tower crane.

In the following non-limiting example, the tower crane comprises a vertical mast 6, which materializes the vertical axis (ZZ'), a substantially horizontal boom 4 carried by the mast 6 and orientable in azimuth (yaw) about the mast 6, and a carriage 7 which is movably mounted in radial translation along said boom.

The carriage 7 carries the load 2, suspended from the carriage by a cable 5 whose length can be modified by means of a winch.

In what follows, for convenience of description, the crane 3 will be assimilated to a tower crane and the vertical axis (ZZ') to a mast 6.

The command control system 1 includes particularly a drive device 10, a monitoring and control device 20, a controller 30, and a command execution system 40.

The command execution system 40 typically includes:

- a lift motor device 41 coupled to the winch, able to move the load 2 according to a lifting movement, depending on received setpoints;
- a distribution motor device 42 coupled to the carriage 7, able to move said carriage 7 according to a distribution movement, depending on received setpoints; and
- an orientation motor device 43 coupled to the boom 4, able to move said boom, and therefore the carriage 7 and the suspended load 2 according to an orientation movement, depending on the received setpoints.

The command execution system 40 also includes a measuring system 45 configured to deliver an MES set of physical and mechanical measurements, related to the motor devices 41-42-43, to the load, as well as to the environment of the crane 3.

More particularly, the measuring system 45 includes a set of sensors for measuring the mass of the load, which may be delivered as part of the MES set of physical and mechanical measurements.

The measuring system 45 also includes a set of sensors for determining, at each moment, the position, the speed and the acceleration of the main members of the command execution system 40, in particular the carriage 7, the boom 4, and the devices mechanically coupled to the load 2, which may also be delivered as part of the MES set of physical and mechanical measurements.

The drive device 10 is configured to produce lifting speed setpoints CMD according to interactions with a crane operator and to transmit said lifting speed setpoints CMD to the monitoring and control device 20. The lifting speed setpoints CMD may include in particular positioning, and/or speed, and/or acceleration setpoints intended particularly to be transmitted to the lift motor device 41.

The drive device 10 generally comprises a user interface, for example of the joystick type, which is intended to be manipulated by a crane operator to produce the lifting speed setpoints CMD. However, the lifting speed setpoints CMD can also be produced by other means, such as an automated drive device.

The monitoring and control device 20 is coupled to the drive device 10 to receive the lifting speed setpoints CMD and to the system to measure the drive execution system 40 to receive the set of measurements MES.

The monitoring and control device 20 is configured to produce, according to the lifting speed setpoints CMD and to the set of measurement MES, optimized lifting speed setpoints CMD' intended to be executed by the lift motor device 41 for displacing the suspended load 2 according to a lifting movement so that the acceleration related to the lifting movement remains, in absolute value, less than or equal to a maximum permitted lifting acceleration $L''_{MAX}$.

The controller 30 is coupled to the drive execution system 40 and to the monitoring and control device 20 in order to receive optimized setpoints of optimized lifting speed CMD'.

The controller 30 is configured to control the lift motor device 41 belonging to the command execution system 40, according to the optimized setpoints of optimized lifting speed CMD'.

Typically, the controller 30 includes automated control means, for example in a closed loop, in order to control, according to the information transmitted by the sensors of the measuring system and to the information comprised in the optimized lifting speed setpoints CMD', the positioning, the speed and/or the acceleration of the mechanical members of the command execution system 40.

Figure 2:
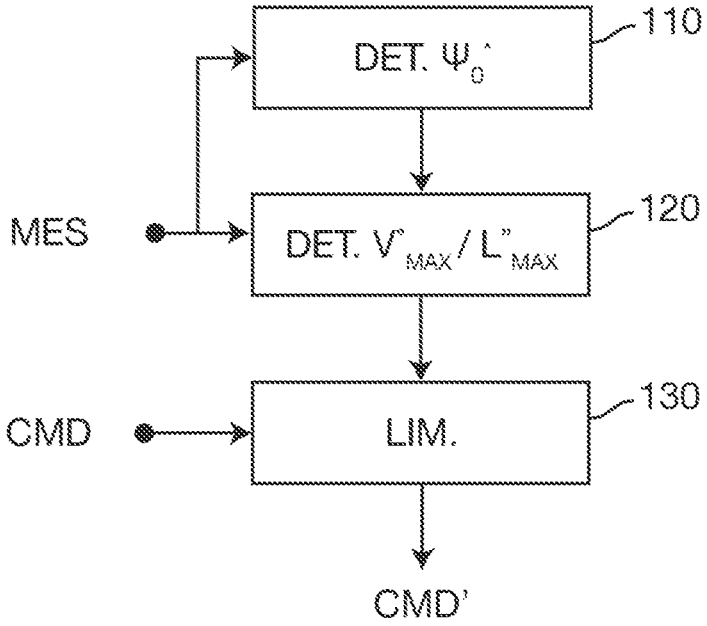
FIG. 2 is a summary chart of the steps of a method for controlling the command of the lifting of a suspended load, according to one embodiment.

Reference is made to FIG. 2 which shows a summary chart of the steps of a method, according to the invention, for controlling the command of the lifting of a load 2 suspended from a boom 4, carried by a mast 6 of a crane 3 (for example, a tower crane).

The method is suitable for being implemented by the command control system 1, for example, by the monitoring and control device 20.

During a first step 110, a specified load factor $\psi_0$* is determined, depending on the mass M of the suspended load.

The specified load factor $\psi_0$* quantifies an acceptable exceedance with respect to a predetermined maximum allowable load for said crane. The specified load factor $\psi_0$* can be determined by means of a maximum allowable load curve, corresponding to a predetermined limit load factor $\psi_0$ and to a maximum static load.

In one embodiment, the limit load factor $\psi_0$ is determined from a first theoretical threshold dependent on the theoretical load capacities handled by the crane and from a second threshold dependent on measurement uncertainties related to the mass of the suspended load and/or to the lifting movement of the suspended load. The first theoretical threshold is typically defined from a theoretical mechanical model of an ideal crane.

The limit load factor $\psi_0$ is for example obtained by adding the first theoretical threshold and the second threshold. For example, if we consider a first theoretical threshold allowing a 10% exceedance of the maximum load and a second threshold allowing an additional 7.5% exceedance related to the measurement uncertainties, the limit load factor $\psi_0$ is then equal to 10%+7.5%=17.5%.

The specified load factor $\psi_0$* may in particular be obtained by multiplying the predetermined limit load factor $\psi_0$ by the ratio between, on the one hand, the maximum static load corresponding to the maximum allowable load curve established for the limit load factor $\psi_0$ and, on the other hand, the effective mass M of the suspended load 2 manipulated by the crane 3 at the considered moment.

Thus, for a given limit load factor $\psi_0$ and therefore for a given maximum base load curve, the lower the mass M of the suspended load 2, the higher the specified load factor $\psi_0$*.

The predetermined limit load factor $\psi_0$ may be in particular chosen according to business rules and/or vary according to the area of use of the crane.

During a second step 120, a maximum permitted lifting acceleration $L''_{MAX}$ is determined, depending in the mass M of the suspended load, on the specified load factor $\psi_0$*, on the distribution position $X_c$ of the load suspended 2 with respect to the mast 6.

Preferably, the maximum permitted lifting acceleration $L''_{MAX}$ is also determined depending on inertia components $J_z$ specific to the structure of the crane 3.

Figure 5:
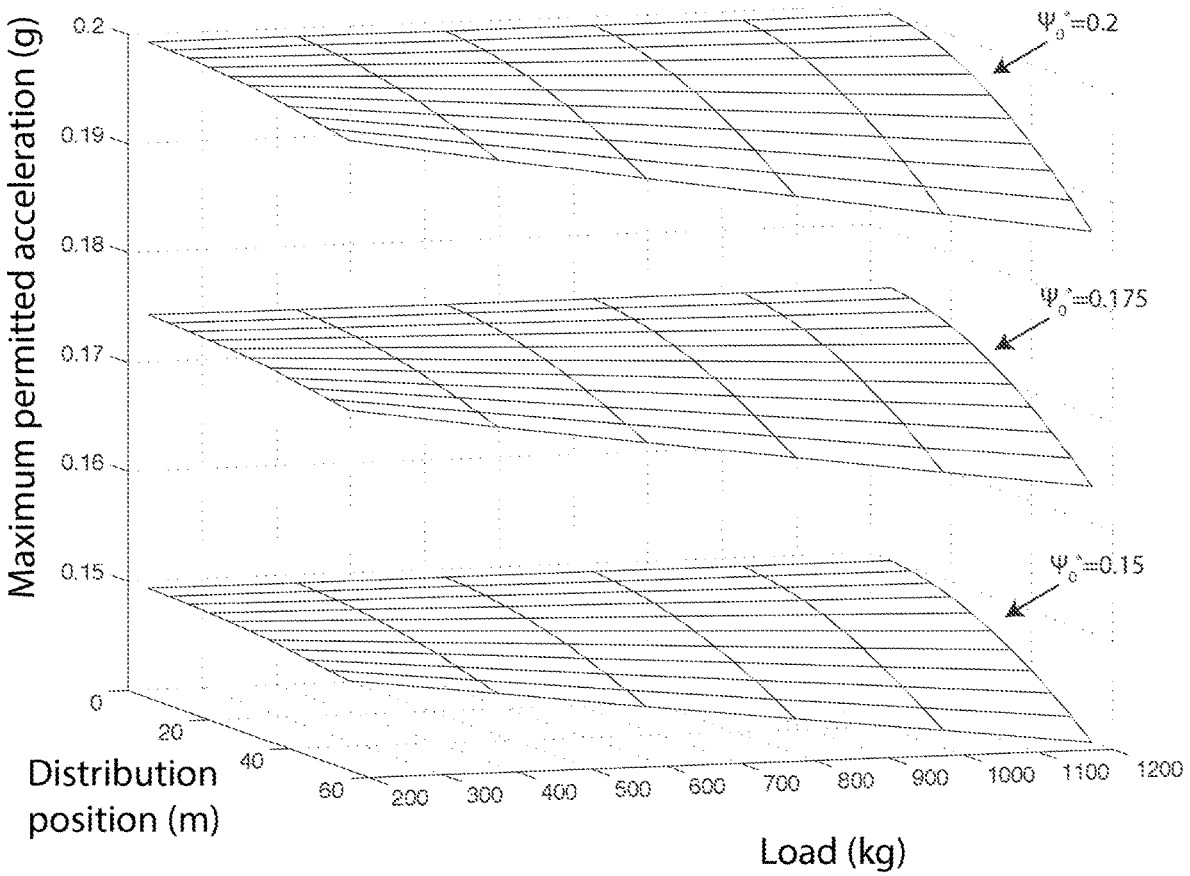
FIG. 5 represents a diagram including a set of surface curves describing the maximum permitted lifting acceleration, depending on the mass M of the load and on the distribution position of the load, each surface curve corresponding to a specified load factor.

By way of example, FIG. 5 represents a diagram including a set of surface curves describing the maximum permitted lifting acceleration $L''_{MAX}$, expressed in g (1 g corresponding to the gravitational acceleration), depending on the mass M of the suspended load 2, expressed in kilograms, and on the distribution position $X_c$ of said suspended load, expressed in meters.

Each surface curve corresponds to a specified distinct load factor $\psi_0$*.

As a reminder, the limit load factor $\psi_0$ used to determine the specified load factor $\psi_0$* can be freely chosen by the person in charge of configuring the crane.

In the example of FIG. 5, the set includes three surface curves corresponding to a specified load factor $\psi_0$* equal, respectively, to 0.15, 0.175, 0.2.

It is of course possible to use a set including a higher number of surface curves, so as to cover more finely and/or over a larger range, different values for the specified load factor $\psi_0$*.

Thus, during the second step 120, the maximum permitted lifting acceleration $L''_{MAX}$ can be determined, at any time, depending on the mass M and on the distribution position Xc, by determining by means of the surface curve corresponding to the specified load factor $\psi_0$*.

During a third step 130, optimized lifting speed setpoints CMD' are determined from lifting speed setpoints CMD.

The optimized lifting speed setpoints CMD' are intended to be executed by the lift motor device 41 for displacing the suspended load 2 according to a lifting movement so that the acceleration specific to the lifting movement remains, in absolute value, less than or equal to the maximum permitted lifting acceleration $L''_{MAX}$.

It should be noted that the maximum allowed lifting acceleration $L''_{MAX}$ is variable, according to the specified load factor $\psi_0$*.

The maximum permitted lifting acceleration $L''_{MAX}$ is thus used as a value limiting the speed variations of the suspended load, imparted by the motor device 41 at the origin of the lifting movement.

The optimized lifting speed setpoints CMD' can furthermore be determined, depending on the lifting speed setpoints CMD received from the drive device 10, so that their implementation by the command execution system 40 also respects one or more of the constraints of the following non-exhaustive list:

- a maximum permitted lifting speed $V_{MAX\ BRK}$, determined depending on the capacities of the crane to slow down the movements of the suspended load 2, to allow desirable braking of the load at any time;
- a maximum suitable lifting speed $V_{MAX\ SEC}$, determined depending on the capacities of the crane 3 to withstand a sudden lying of the suspended load 2 on the ground or an emergency stopping, so that the resulting dynamics remain in an envelope suitable for the structure—said envelope being different from the nominal load curve;
- a maximum lifting acceleration $L''_{SEC}$ achievable by means of the lift motor device 41;
- a minimum lifting acceleration $L''_{MIN}$, called "minimum comfort acceleration", which is predetermined so as to set a lifting acceleration value which is high enough to provide a certain lifting comfort, but whose value is low enough (in absolute value) to substantially avoid unsuitable crane conditions; in practice, this minimum comfort acceleration can be used instead of the maximum acceleration $L''_{MAX}$ not to immobilize the crane unnecessarily.

Reference is now made to FIG. 4 which shows a block diagram used to describe an oscillator-type mechanical model, used, according to one embodiment of the invention, during the second step 120, to determine the maximum permitted lifting acceleration $L''_{MAX}$.

The mechanical model presented below allows establishing an inequality between the maximum permitted lifting acceleration $L''_{MAX}$ and specified the load factor $\psi_0$*. As long as this inequality is respected, the effective instantaneous load factor $\psi$—corresponding to the conditions of transport of the load at the considered moment—remains lower than the specified load factor $\psi_0$*. Thus, the static and dynamic load undergone at the considered moment by the crane should not exceed the maximum allowable exceedance set by the maximum allowable load curve.

The mechanical model can thus be described by means of the following mathematical expressions:

$$J_z\ddot{\theta}=-K\theta+x_cF_z$$

$$J_z\ddot{\theta}_0=-K\theta_0+x_cF_{z0}$$

$$M\ddot{L}=(F_z-Mg)$$

$$M\ddot{L}_0=(F_{z0}-Mg)$$

wherein

- $\theta$ represents the pitch deflection angle of the boom 4 (that is to say the angle formed in terms of pitch by the deformation of the boom 4 with respect to the position of said vacuum boom, due to the deformation by bending in tilting of said boom 4 under the effect of the load);
- $\Delta F_z=F_z-Mg$ corresponds to the variation of the vertical force related to the load, $F_z$ being the vertical load at the considered moment;
- $J_z$, K corresponds to a model of stiffness and inertia of the first order related to the structure of the crane; more particularly, K corresponds to the stiffness of the boom 4 in terms of pitch bending, and $J_z$ the inertia of the boom 4 with respect to its point of intersection with the mast 6;
- M corresponds to the mass of the load;
- $\tilde{\theta}=\theta-\theta_0$ corresponds to the variation of the horizontal angle of the boom;
- $\tilde{L}=L-L_0$ corresponds to the load height variation directly proportional to the length of cable wound/unwound at the lifting winch, or to the directly related variable;

we deduce therefrom:

$$J_z\ddot{\tilde{\theta}}=-K\tilde{\theta}+x_c\Delta F_z$$

$$M\ddot{\tilde{L}}=\Delta F_z$$

It should be noted that the effect of damping stiffness is neglected since it does not amplify the dynamic effects of the boom when the dynamic factor is significant—(as it is the case in the load-lifting phase or in a significant variation).

We can consider:

$$-K\tilde{\theta}+x_c\Delta F_z\leq x_c\Delta F_z$$

Since $$M\ddot{\tilde{L}}=\Delta F_z$$

and consequently:

$$x_c\Delta F_z=x_cM\ddot{\tilde{L}}$$

the following mathematical expression is thus obtained:

$$J_z\ddot{\tilde{\theta}}=-K\tilde{\theta}+x_c\Delta F_z\leq Mx_c\ddot{\tilde{L}}$$

The effective instantaneous load factor $\psi$ corresponds to the quotient of the sum of the vertical acceleration of the suspended load—that is to say the winding or unwinding acceleration of the cable—and of the acceleration related to the pitch deflection of the crane boom, to the numerator, by the gravitational acceleration g, to the denominator, that is to say, corresponds to the sum, added to the gravitational acceleration, of the vertical acceleration of the load and of the acceleration related to the deflection of the boom 4. Thus, the instantaneous effective load factor ψ can be described by the following mathematical expression:

$$\Psi = \frac{\ddot{\tilde{L}}}{g} + \frac{x_c\ddot{\theta}}{g}$$

Thus, the following inequality is obtained:

$$\Psi = \frac{\ddot{\tilde{L}}}{g} + \frac{x_c\ddot{\theta}}{g} \leq \frac{x_c^2 M + J_z}{gJ_z}\ddot{\tilde{L}}$$

Consequently, if we choose to limit the lifting acceleration $\ddot{\tilde{L}}$ so that we satisfy:

$$\ddot{\tilde{L}} < \frac{gJ_z}{(x_c^2 M + J_z)}\Psi_0^*$$

Then we will necessarily have:

$$\Psi \leq \frac{x_c^2 M + J_z}{gJ_z}\ddot{\tilde{L}} < \frac{x_c^2 M + J_z}{gJ_z}\frac{gJ_z}{(x_c^2 M + J_z)}\Psi_0^*$$

Namely:

$$\psi < \psi_0^*$$

Thus, the effective instantaneous load factor ψ will always be less than the specified load factor $\psi_0^*$.

In one embodiment, during the third step 130, the limitation of the lifting speed variations, that is to say the limitation of the lifting acceleration, with respect to the specified load factor $\psi_0^*$, limitation which allows imposing the above inequality, is preferably obtained by the application of a LIM function of the ramp limiter type, more commonly referred to as "ramp limiter". The LIM function of the ramp limiter type ensures that the speed variation requested at the input never exceeds a maximum acceleration threshold. Thus, the speed setpoint at the output of the LIM function meets the objective set by the designer.

In one embodiment, the LIM function describes a ramp whose slope corresponds to the maximum permitted acceleration $L''_{MAX}$.

Also, by way of example, in response to a stage of speed commands comprised in the CMD instructions, requested by the crane operator, the optimized setpoints CMD' will comprise speed setpoints to be applied, whose value increases gradually, for a predefined period of time, following the ramp described by the LIM function, whose slope corresponds to the maximum permitted acceleration $L''_{MAX}$ so that the inertial effects are limited.

Figure 3:
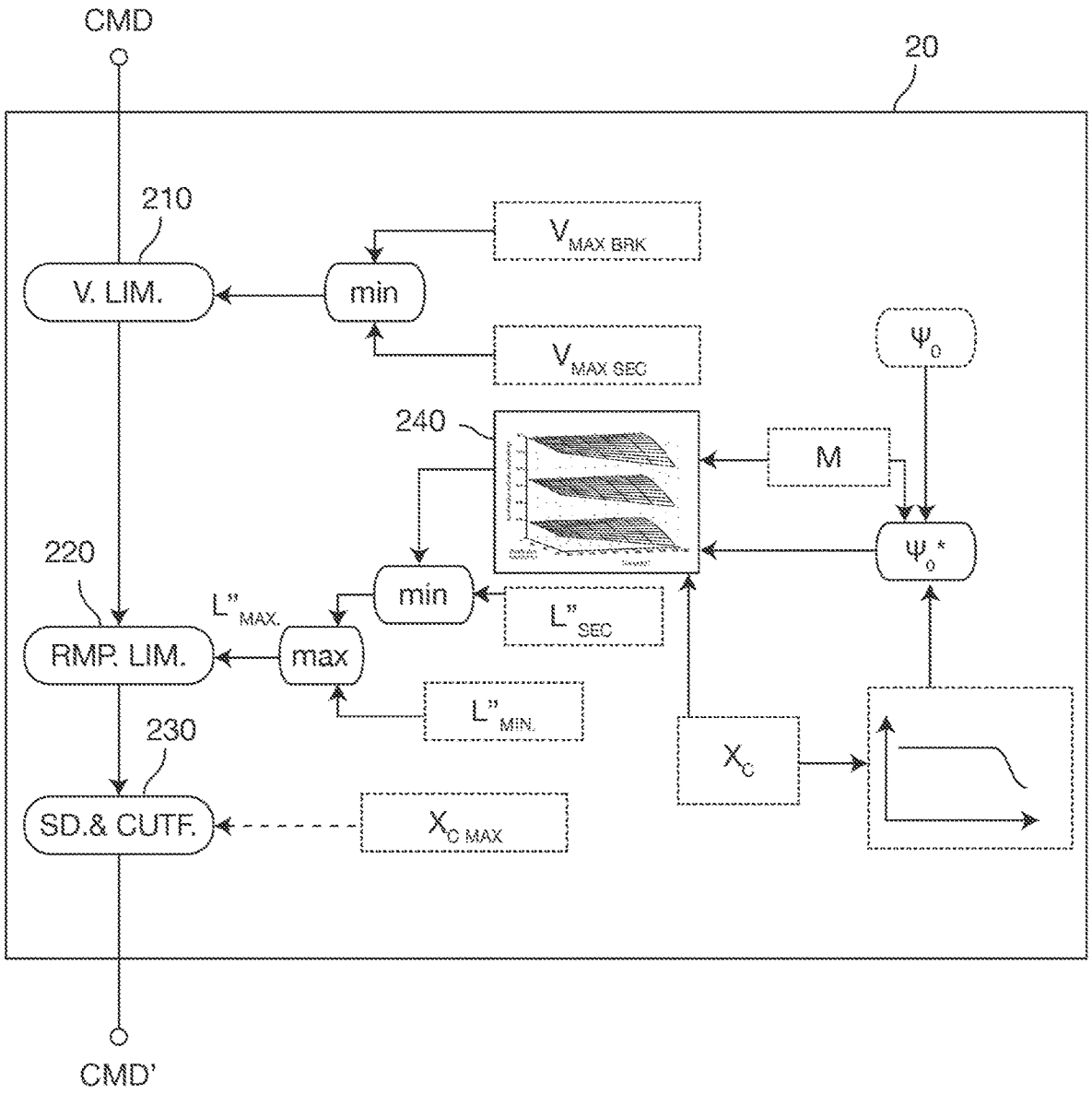
FIG. 3 represents a block diagram of the monitoring and control device, according to one embodiment of the invention.

Reference is now made to FIG. 3 which shows a block diagram of the monitoring and control device 20, according to one embodiment of the invention. In this embodiment, the monitoring and control device 20 is configured to implement the lifting control and command method, previously described, by means of the mathematical model as described above, with reference to FIG. 4.

More particularly, the monitoring and control device 20 includes a speed limiter module 210, an acceleration limiter module 220, and a braking and cut-off module 230 (noted SD&CUTF for "SlowDown & CutOff).

The speed limiter module 210 is configured to produce, to the acceleration limiter module 220, a target setpoint of higher lifting speed CV, according to the lifting speed setpoints CMD, sent by the drive device 10. The target setpoint of higher lifting speed CV is determined by calculating the result of a limiter function $LIM_V$ for the value corresponding to the minimum between:

- the maximum permitted speed $V_{MAX\ BRK}$, depending on the capacities of the crane to brake the movements of the suspended load; and,
- the maximum suitable lifting speed $V_{MAX\ SEC}$, determined depending on the capacities of the crane to withstand a sudden lying of the suspended load on the ground and/or an emergency stopping (braking and cut-off of the lifting movement), so as to avoid jolts in such situations.

The acceleration limiter module 220 includes a calculation module 240 of the maximum acceleration $L''_{MAX}$, according to the specified load factor $\psi_0^*$, of the distribution position $X_c$ and of the mass M.

The calculation module 240 may include reading means in a preconfigured memory of an abacus/mapping corresponding to a set of surface curves as shown in FIG. 5.

Alternatively, the calculation module 240 may include calculation means using an explicit mathematical description, as described above with reference to FIG. 4, to determine the maximum acceleration $L''_{MAX}$.

The acceleration limiter module 220 is configured to determine the speed setpoint value applicable to the lift motor 41, and progressively bring said speed setpoint to the higher lifting speed value CV, by applying as a rate of variation (slope $V_{L''}$ of the acceleration ramp), a value VL" which corresponds to the maximum between:

- on the one hand, the minimum value between:
  - the maximum lifting acceleration $L''_{MAX}$ determined by the calculation module 240; and,
  - the maximum lifting acceleration $L''_{SEC}$ achievable by the lift motor device 41 (so that the acceleration setpoint cannot exceed the material capacities of the lift motor 41); the value retained accordingly at the considered moment therefore corresponds advantageously to the most constraining operating requirement, and therefore to the most unfavorable operating condition;
- and, on the other hand, a minimal lifting acceleration $L''_{MIN}$, called "comfort lifting acceleration".

The minimum lifting acceleration $L''_{MIN}$ corresponds to a minimum comfort acceleration for the driving of the crane by the crane operator. As indicated above, this minimum comfort acceleration is chosen sufficiently low for desired operation of the crane, while being high enough not to immobilize the crane unnecessarily, particularly when the maximum lifting acceleration $L''_{MAX}$ calculated is, punctually, exceptionally low or abnormally low.

The lifting acceleration value retained, applicable at the considered moment, and therefore the slope $V_{L''}$ of the corresponding acceleration ramp, thus reflects the best possible compromise, taking into account the operating safety requirements.

Advantageously, the acceleration limiter module 220 includes means for limiting, over time, the lifting acceleration corresponding to the received target lifting speed setpoints CV, by the application of the LIM function of the ramp limiter type, describing a ramp whose slope corresponds to the value $V_{L''}$. The LIM function of the ramp limiter type allows clamping the speed variation requested at the input so that the lifting acceleration observed in absolute value remains lower than the value $V_{L''}$.

Preferably, the braking and cut-off module 230 is configured to ensure that the optimized setpoints CMD' produced depending on the acceleration setpoints CA, do not cause the displacement of the load according to the distribution movement beyond a limit position $X_{C\ MAX}$. If necessary, the cut-off module 230 modifies the optimized setpoints CMD' so that the load does not exceed the limit position $X_{C\ MAX}$ after the implementation of the optimized instructions CMD'. It will be noted, more generally, that the invention preferably advantageously superimposes conventional range, movement and/or control limiting devices allowing to stop the movements of the crane in case of occurrence of an overload or approaching overload condition.

Thus, optimized instructions CMD' can be typically transmitted to said traditional range, movement and/or control limiting devices of the crane, which therefore can remain active to ensure their usual mission.

More particularly, the braking and cut-off module 230 can thus slow down the lift motor 41 or even stop it when the load approaches, or even reaches, the predefined limit position $X_{C\ MAX}$.

In the embodiments above, the crane 3 may be provided with the system 1 for controlling the lifting of the suspended load 2. The system 1 may further include the processor and a memory, such as the computer-readable recording medium, configured to store the computer program including instructions for performing the steps of the methods described in the embodiments above, including, but not limited to, the steps 110, 120, 130. The processor is configured to execute the instructions of the computer program to perform the above-referenced method steps in accordance with the embodiments described herein.

For example, the processor, and by extension the system 1, is configured to: determine, depending on the mass of the suspended load, a specified load factor quantifying an acceptable exceedance with respect to a predetermined maximum allowable load for said crane; determine a maximum permitted lifting acceleration, depending on the mass of the suspended load, on the specified load factor and on the distribution position of the load suspended on the boom with respect to the mast; and determine, from lifting speed setpoints, optimized lifting speed setpoints intended to be executed by a motor device for displacing the suspended load according to a lifting movement so that the acceleration related to the lifting movement remains, in absolute value, less than or equal to the maximum permitted acceleration.

The processor is operably and/or communicatively coupled to the lift motor device 41 and is configured to control operations of the lift motor device 41 based on the optimized lifting speed setpoints, such that the acceleration related to the lifting movement remains, in absolute value, less than or equal to the maximum permitted acceleration. In one embodiment, the controller 30 is operably and/or communicatively connected between the processor and the lift motor device 41, such that the controller 30 controls operation of the lift motor device 41 based on the optimized lifting speed setpoints in the manner described above.

In one embodiment, the processor and computer-readable recording medium may be implemented in the monitoring and control device 20. The processor and computer-readable recording medium may be operably and/or communicatively connected to various known components including, but not limited to, a display, an input/output device and the like.

Further, the processor and/or computer-readable recording medium may be operably and/or communicatively connected to the command execution system 40, including the measuring system 45, and configured to receive the MES set of physical and mechanical measurements related to the motor devices 41, 42, 43, to the load as well as to the environment of the crane 3. That is, the processor and/or computer-readable recording medium may be configured to receive various measurements recorded by the set of the sensors of the measuring system 45. Such measurements may include, but are not limited, the mass M of the suspended load, the distribution position $X_c$ of the load suspended on the boom.

The computer-readable recording medium may store information, including, but not limited, the measurements recorded by the set of sensors such as the mass M of the load and the distribution position $X_c$, a predetermined maximum allowable load for the crane, the specified load factor $\psi_0$*, inertia components $J_z$, and/or a maximum allowable load curve corresponding to a predetermined limit load factor $\psi_0$ and to a maximum static load, and other information used in the methods described herein. The computer-readable recording medium may include single memory unit or a plurality of memory units operable connected, for example, to the processor, either directly or indirectly.

Alternatively, or in addition, information described herein as being measured by the set of sensors may, in some instances, be determined by the system 1 based on related measurements or manually input into the system 1. Various components of the system 1 may be disposed on the crane 3, distributed at different locations and/or components on the crane 3, positioned remotely and operably and/or communicatively connected to the crane, or some combination thereof.

The invention claimed is:

1. A method for controlling the command of the lifting of a load suspended from a boom, carried by a mast of a crane, the method including:

determining, depending on a mass (M) of the suspended load, a specified load factor ($\psi_0$*) quantifying an acceptable exceedance related to a predetermined maximum allowable load for said crane;

determining a maximum permitted lifting acceleration ($L''_{MAX}$), depending on the mass (M) of the suspended load, the specified load factor ($\psi_0$*) and a distribution position ($X_c$) of the load suspended on the boom with respect to the mast;

determining, from lifting speed setpoints (CMD), optimized lifting speed setpoints (CMD') to be executed by a motor device for displacing the suspended load according to a lifting movement so that an acceleration related to the lifting movement remains, in absolute value, less than or equal to the maximum permitted acceleration ($L''_{MAX}$).

2. The method according to claim 1, wherein the maximum permitted lifting acceleration ($L''_{MAX}$) is determined using the following mathematical expression:

$$\frac{gJ_z}{x_c^2M + J_z}\psi_0^*$$

wherein:

$x_c$, corresponds to the distribution position of the suspended load;

M corresponds to the mass of the suspended load; and $J_z$ corresponds to a model of stiffness and inertia of the first order related to the structure of the crane.

3. The method according to claim 1, wherein the specified load factor ($\psi_0$*) is determined from a maximum allowable load curve, corresponding to a limit load factor ($\psi_0$) and to a maximum static load.

4. The method according to claim 3, wherein the limit load factor ($\psi_0$) is determined from a first theoretical threshold dependent on theoretical load capacities handled by the crane and from a second threshold dependent on measurement uncertainties related to the mass of the suspended load and/or to the lifting movement of the suspended load.

5. The method according to claim 3, wherein the specified load factor ($\psi_0$*) is obtained by multiplying the limit load factor ($\psi_0$) by a ratio between the maximum static load corresponding to the maximum allowable load curve and the mass (M) of the suspended load.

6. The method according to claim 1, wherein the optimized lifting speed setpoints (CMD') are determined so that their execution by the motor device for displacing the suspended load according to the lifting movement meets the following condition:

the lifting acceleration of the suspended load, in absolute value, remains less than or equal to the maximum permitted acceleration ($L''_{MAX}$); and one or more of the following additional conditions:

the lifting speed of the suspended load, in absolute value, remains lower than a maximum permitted lifting speed ($V_{MAX\ BRK}$), the maximum permitted lifting speed ($V_{MAX\ BRK}$) being determined depending on the capacities of the crane to slow down the movements of the suspended load; and/or the lifting speed of the suspended load, in absolute value, remains lower than a maximum safety lifting speed ($V_{MAX\ SEC}$), determined depending on the capacities of the crane to withstand a sudden lying of the suspended load on the ground and/or an emergency stopping; and/or the lifting acceleration of the suspended load, in absolute value, remains lower than a maximum lifting acceleration ($L''_{SEC}$) achievable by the motor device; and/or the lifting acceleration of the suspended load, in absolute value, remains greater than a minimal lifting acceleration ($L''_{MIN}$).

7. The method according to claim 1, wherein the optimized lifting speed setpoints are determined so that the absolute value of the lifting speed of the suspended load increases, over a predefined period of time, along a ramp having a slope corresponding to the maximum permitted lifting acceleration ($L''_{MAX}$).

8. A computer program including instructions for performing the steps of the method according to claim 1, when said program is executed by a processor.

9. A computer-readable recording medium on which is recorded a computer program comprising instructions for performing the steps of the methods according to claim 1.

10. The method according to claim 1, further comprising:

controlling operation of the motor device based on the optimized lifting speed setpoints (CMD').

11. A tower crane including a mast supporting a boom on which is mounted a carriage intended to carry a suspended load, the tower crane further comprising a system for controlling the command of the lifting of the suspended load, the system configured to:

determine, depending on the mass (M) of the suspended load, a specified load factor ($\psi_0$*) quantifying an acceptable exceedance with respect to a predetermined maximum allowable load for said crane;

determine a maximum permitted lifting acceleration ($L''_{MAX}$), depending on the mass (M) of the suspended load, on the specified load factor ($\psi_0$*) and on the distribution position ($X_c$) of the load suspended on the boom with respect to the mast;

determine, from lifting speed setpoints (CMD), optimized lifting speed setpoints (CMD') intended to be executed by a motor device (41) for displacing the suspended load according to a lifting movement so that the acceleration related to the lifting movement remains, in absolute value, less than or equal to the maximum permitted acceleration ($L''_{MAX}$).

12. The tower crane of claim 11, wherein the system is further configured to control operation of the motor device based on the optimized lifting speed setpoints (CMD').

* * * * *